US006454123B1

(12) United States Patent
Ritson

(10) Patent No.: US 6,454,123 B1
(45) Date of Patent: Sep. 24, 2002

(54) STABILIZING CADDY FOR PRESSURIZED GAS CONTAINER

(76) Inventor: John D. Ritson, 12 Northwoods Rd., North Granby, CT (US) 06060

( * ) Notice: Subject to any disclaimer, the term of this patent is extended or adjusted under 35 U.S.C. 154(b) by 0 days.

(21) Appl. No.: 09/792,272

(22) Filed: Feb. 24, 2001

(51) Int. Cl.[7] ..... B65D 25/00
(52) U.S. Cl. ..... 220/630; 220/632
(58) Field of Search ..... 220/630, 632, 220/729, 730

(56) References Cited

U.S. PATENT DOCUMENTS

| | | | | | |
|---|---|---|---|---|---|
| D110,902 | S | * | 8/1938 | Loesch | 220/630 X |
| 2,683,579 | A | * | 7/1954 | Wallace | 220/632 X |
| 2,936,926 | A | * | 5/1960 | Miller | 220/632 X |
| 3,606,074 | A | * | 9/1971 | Hayes | 220/630 X |
| 3,831,209 | A | * | 8/1974 | Clingman | 220/630 X |
| 4,905,945 | A | * | 3/1990 | Peterson | 220/630 X |
| 6,302,291 | B1 | * | 10/2001 | McCleerey | 220/630 |

* cited by examiner

*Primary Examiner*—Steven Pollard
(74) *Attorney, Agent, or Firm*—Albert W. Hilburger

(57) ABSTRACT

A stabilizing caddy for a pressurized gas container includes a base and a housing upstanding from the base. The housing has a cavity defined by a continuous side wall with an upper rim distant from the base and a longitudinal axis extending transverse of the base. The continuous side wall of the housing cavity is uniformly snugly supportively receptive of an outer surface of the pressurized gas container when the pressurized gas container is slidably received therein such that a longitudinal axis of the gas container is substantially parallel to the longitudinal axis of the cavity. The dimension of the housing at the upper rim transverse of the longitudinal axis is substantially less than that of the base. In one embodiment, the housing is substantially conical in shape. In other embodiments, the housing may alternatively be of solid material or of thin wall construction. In yet another embodiment, the housing includes an upstanding tubular member encompassing the cavity, the base being an integral planar plate extending transverse of the longitudinal axis of the cavity and including a plurality of circumferentially spaced rib members lying in planes substantially parallel to the longitudinal axis of the cavity integral with and extending between the tubular member and the planar plate.

10 Claims, 3 Drawing Sheets

STABILIZING CADDY FOR PRESSURIZED GAS CONTAINER

BACKGROUND OF THE INVENTION

1. Field of the Invention

The present invention relates to apparatus for supporting and transporting pressurized gas containers and, more particularly, to a stabilizing caddy which protects the gas container while maintaining it in an upright position.

2. Prior Art

It is common to store pressurized gas in cylindrical tanks having a bottom end on which they normally stand and an upper end to which the outlet valve is attached. These tanks are generally of a small range of standard sizes. In some instances, they are tall and slim and when in use are normally supported by a suitable frame. However, in the case of propane tanks, particularly small propane tanks such as those designated as 20 pound tanks, the tank is still cylindrical, but nearly spherical. These are provided with a foot customarily in the form of an annular collar attached to the lower end of the tank. These small propane tanks are quite commonly transported, either for refilling or from place to place for supplying gas barbecues, for example, or to job sites where they are used by a variety of tradesmen. In such instances, the tank may be stood on its foot and suitable controls, valves, and the like attached to the upper outlet of the tank. In any of these situations, whether being transported or being used with heating equipment attached to the upper end, the tank is not very stable since the annular collar mounted on the lower end of the tank is substantially smaller than the outer diameter of the tank. While this construction may be adequate when the tank is in use, it is essential that the tank be stabilized when it is being transported.

In the past one solution to this problem has been to retain the tank in the corrugated cardboard box in which it was packaged when new. However, such a container soon loses its shape and strength, especially when subjected to moisture over a period of time.

Other solutions have been devised over the years. Indeed, there is an abundance of known devices for supporting gas containers and other items as they are being transported. A number of patents can be mentioned which disclose typical instances of these devices. For example, U.S. Pat. No. 2,497,597 to Gatewood and U.S. Pat. No. 2,985,310 to Norris both disclose a carrier and frame for mounting to the front of a mobile home or trailer. U.S. Pat. No. 5,299,721 to Cummings discloses apparatus for receiving and supporting SCUBA tanks in a boat. U.S. Pat. No. 4,303,367 to Bott discloses a container having a plurality of open-topped receptacles for supporting loaded shopping bags in a vehicle in an upright position. U.S. Pat. No. 5,065,922 to Harris discloses a container system for a delivery van used for delivering floral packages.

Numerous other constructions for receiving and supporting propane tanks and the like but not necessarily associated with a vehicle are revealed, for example, in U.S. Pat. No. 4,907,712 to Stempin, U.S. Pat. No. 4,905,855 to Troiano et al., U.S. Pat. No. 4,848,711 to Mandel, U.S. Pat. No. 3,217,892 to Goodell, U.S. Pat. No. 2,526,009 to Daniels, and Des. U.S. Pat. No. 138,395 to Howard.

It was with knowledge of the foregoing state of the technology that the present invention has been conceived and is now reduced to practice.

SUMMARY OF THE INVENTION

The present invention as disclosed and claims relates to a stabilizing caddy for a pressurized gas container which includes a base and a housing upstanding from the base. The housing has a cavity defined by a continuous side wall with an upper rim distant from the base and a longitudinal axis extending transverse of the base. The continuous side wall of the housing cavity is uniformly snugly supportively receptive of an outer surface of the pressurized gas container when the pressurized gas container is slidably received therein such that a longitudinal axis of the gas container is substantially parallel to the longitudinal axis of the cavity. The dimension of the housing at the upper rim transverse of the longitudinal axis is substantially less than that of the base. In one embodiment, the housing is substantially conical in shape. In other embodiments, the housing may alternatively be of solid material or of thin wall construction. In yet another embodiment, the housing includes an upstanding tubular member encompassing the cavity, the base being an integral planar plate extending transverse of the longitudinal axis of the cavity and including a plurality of circumferentially spaced rib members lying in planes substantially parallel to the longitudinal axis of the cavity integral with and extending between the tubular member and the planar plate.

A primary feature, then, of the present invention is the provision of apparatus for supporting and transporting pressurized gas containers.

Another feature of the present invention is the provision of such apparatus in the form of a stabilizing caddy which protects the gas container while maintaining it in an upright position.

Yet another feature of the present invention is the provision of such apparatus which includes a base and a housing upstanding from the base and having a cavity defined by a continuous side wall with an upper rim distant from the base and a longitudinal axis extending transverse of the base, the continuous side wall of the housing cavity being uniformly snugly supportively receptive of an outer surface of the pressurized gas container when the pressurized gas container is slidably received therein such that a longitudinal axis of the pressurized gas container is substantially parallel to the longitudinal axis of the cavity, the dimension of the housing at the upper rim transverse of the longitudinal axis being substantially less than that of the base.

Still a further feature of the present invention is the provision of such apparatus wherein the housing is substantially conical in shape and the cavity is at least tubular and may be cylindrical.

Yet a further feature of the present invention is the provision of such apparatus wherein the housing is of thin wall construction and the space between the continuous side wall and the housing is substantially a void.

Still another feature of the present invention is the provision of such apparatus wherein the housing is substantially a solid.

Yet another feature of the present invention is the provision of such apparatus wherein the housing includes an upstanding tubular member encompassing the cavity, wherein the base is a planar plate integral with the upstanding tubular member extending transverse of the longitudinal axis of the cavity, and including a plurality of circumferentially spaced rib members lying in planes substantially parallel to the longitudinal axis of the cavity integral with and extending between the tubular member and the planar plate.

Other and further features, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention, illustrate one of the embodiments of the invention, and together with the description, serve to explain the principles of the invention in general terms. Like numerals refer to like parts throughout the disclosure.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
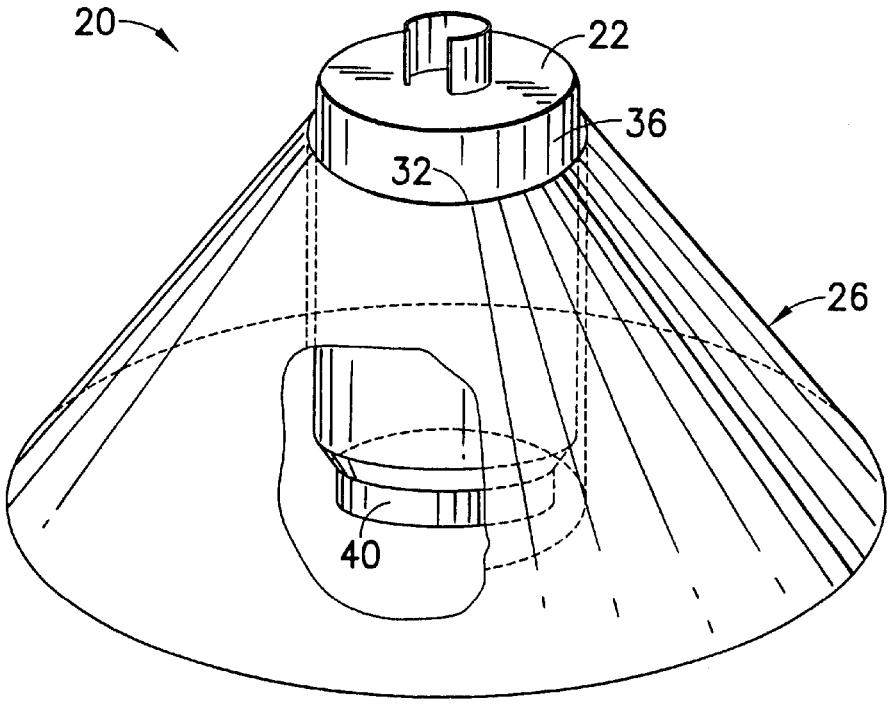
FIG. 1 is perspective view of a stabilizing caddy for a pressurized gas container and embodying the present invention, a pressurized gas container being illustrated in the supported disposition.

Referring to FIG. 1, there is shown a perspective view of one embodiment of a stabilizing caddy 20 for a standard pressurized gas container 22 incorporating features of the present invention. Although the present invention will be described with reference to the embodiments to be described and shown in the drawings, it should be understood that the present invention can be embodied in many alternate forms or embodiments. In addition, any suitable size, shape or type of elements or materials could be used.

Figure 2:
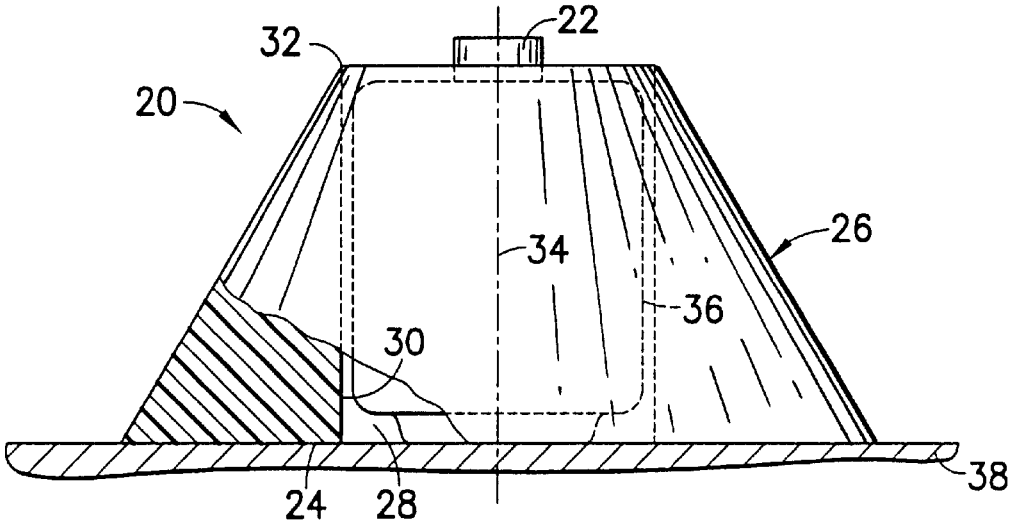
FIG. 2 is a side elevational view, partly cut away and in section, of the stabilizing caddy illustrated in FIG. 1.
Figure 3:
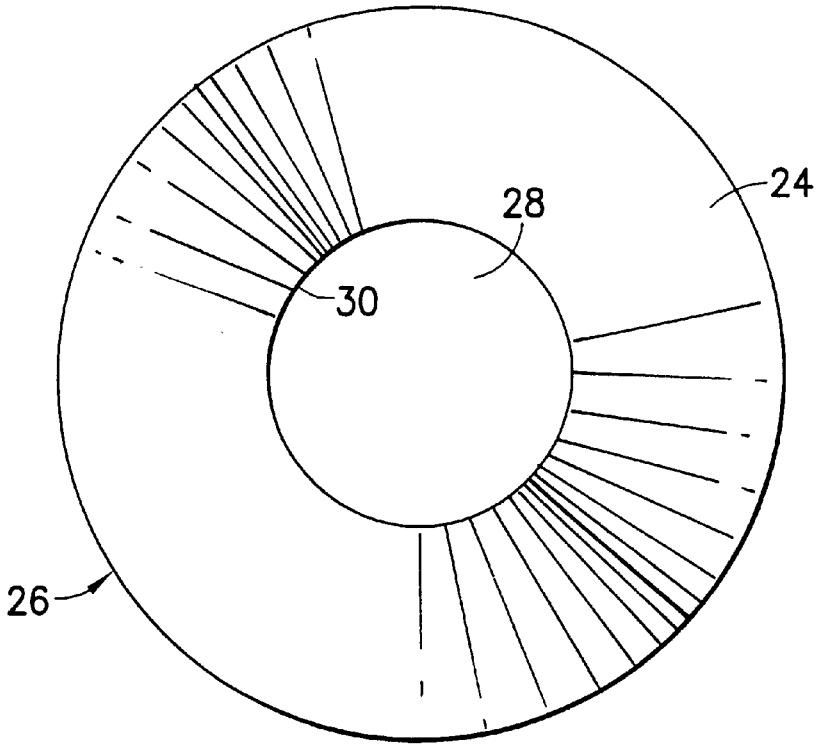
FIG. 3 is bottom plan view of the stabilizing caddy illustrated in FIGS. 1 and 2.

Turning now also to FIGS. 2 and 3, the stabilizing caddy 20 includes a circular base 24 (FIG. 3) and a housing 26 upstanding from the base. A cavity 28 in the housing 26 is defined by a continuous side wall 30 having an upper rim 32 distant from the base 24 and a longitudinal axis 34 extending transverse of the base. As seen in FIGS. 1 and 2, the continuous side wall 30 of the housing cavity 28 is uniformly snugly supportively receptive of an outer surface 36 of the pressurized gas container 22 when the pressurized gas container is slidably received in the cavity such that a longitudinal axis of the pressurized gas container is substantially parallel to the longitudinal axis 34 of the cavity. Again, as best seen in FIGS. 1 and 2, the dimension of the housing 26 at the upper rim 32 transverse of the longitudinal axis 34 is substantially less than that of the base 24. Thus, when the pressurized gas container 22 is supported within the cavity 28 of the stabilizing caddy 20, the combination has a very low center of gravity and therefore exhibits a highly stable system.

In the embodiment of FIGS. 1, 2, and 3, the cavity 28 has no bottom such that when the housing rests on a supporting surface 38, an annular collar 40 attached to the lower end of the pressurized gas container 22 likewise rests on the supporting surface 38. Also in the embodiment of FIGS. 1, 2, and 3, the housing 26 is substantially conical in shape and is of solid construction. The cavity 28 is tubular at the very least but in most instances is substantially cylindrical in shape, sized to receive one of a variety of stand-sized pressurized gas containers. Additionally, the housing is preferably constructed of one of a variety of light weight, yet durable, plastic compositions.

Figure 4:
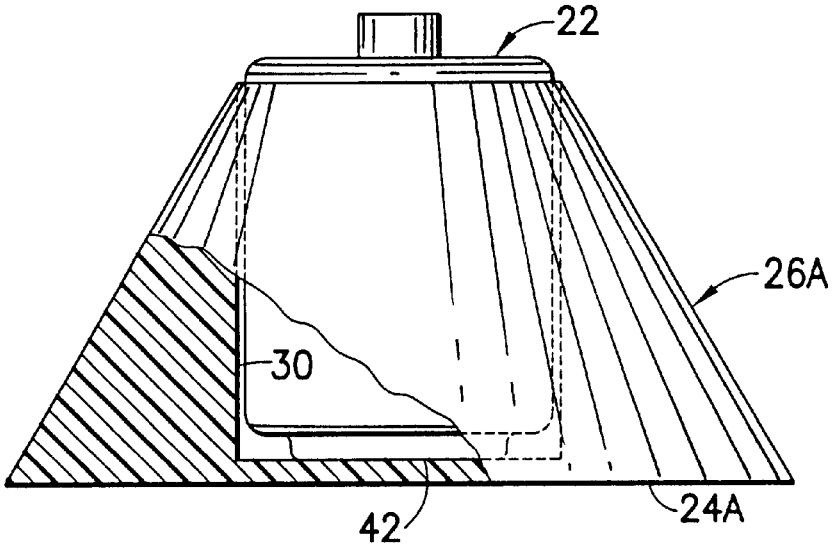
FIG. 4 is a side elevational view, partly cut away and in section, similar to FIG. 2, illustrating a modified stabilizing caddy according to the invention.

In another embodiment illustrated in FIG. 4, a modified housing 26A includes a floor 42 integral and coplanar with a modified base 24A obstructing the cavity 28 and providing a support for the pressurized gas container 22 when received in the cavity.

Figure 5:
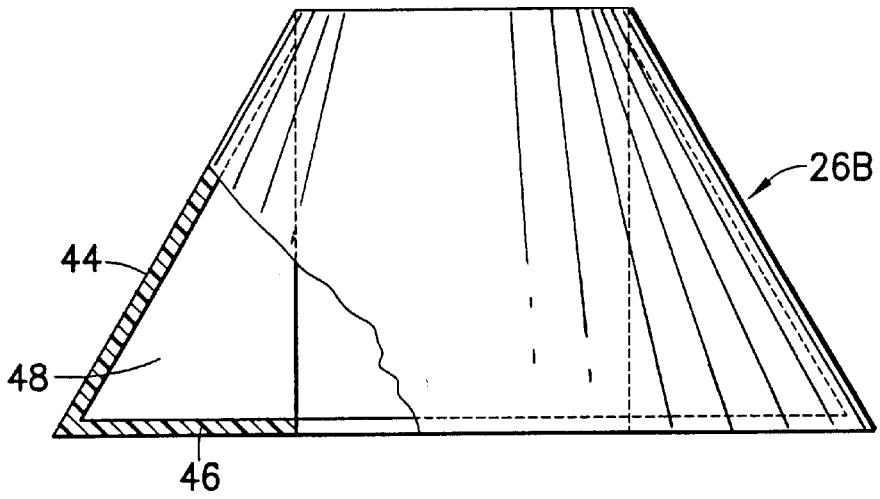
FIG. 5 is a side elevational view, partly cut away and in section, similar to FIGS. 2 and 4, illustrating another modified stabilizing caddy according to the invention.

In still another embodiment illustrated in FIG. 5, a further modified housing 26B is of thin wall construction. In this instance, a continuous conical wall 44 and a base plate 46 are of minimal thickness subject to the strength necessary for the modified stabilizing caddy to perform its task. The space 48 within the housing between the continuous conical wall 44 and the base plate 46 is substantially a void.

Figure 6:
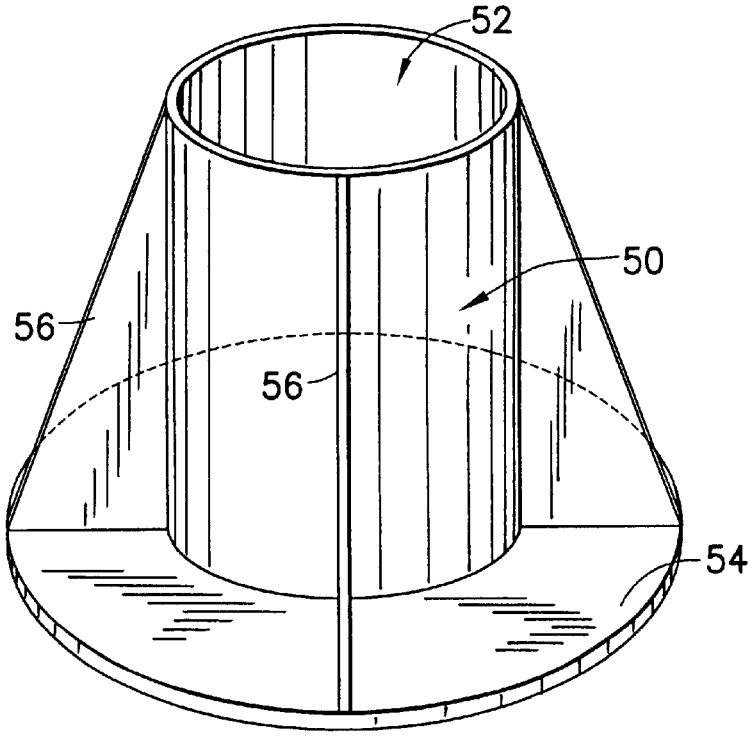
FIG. 6 is a perspective view of another modified stabilizing caddy, according to the invention, for a pressurized gas container.

In still another embodiment illustrated in FIG. 6, a further modified housing 26B includes an upstanding tubular member 50 encompasses a cavity 52 for receiving a pressurized gas container 22. A base 54 integral with the upstanding tubular member 50 is a planar plate which extends transverse of the longitudinal axis of the cavity 52. Continuing with FIG. 6, a plurality of circumferentially spaced rib members 56 lie in planes substantially parallel to the longitudinal axis of the cavity 52 and are integral with and extend between the tubular member 50 and the planar plate 54. With this construction, some of the bulk of the earlier described embodiments is eliminated while retaining the function and sturdy construction necessary for the task of properly supporting a pressurized gas container.

As most clearly seen in the configurations illustrated in FIGS. 1, 2, 3, and 5, the base or bottom of the stabilizing caddy at the location at which the collar and surrounding region of the pressurized gas container meets the caddy is cut out thereby allowing the collar to directly engage the ground or underlying supporting surface resulting in a lowest possible center of gravity.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A stabilizing caddy for a pressurized gas container having a longitudinal axis comprising:

a base; and a housing upstanding from the base and having a cavity defined by a continuous side wall having an upper rim distant from the base and extending to the base and a longitudinal axis extending transverse of the base, the continuous side wall of the housing cavity being uniformly snugly supportively receptive of, and substantially enveloping, an outer surface of the pressurized gas container when the pressurized gas container is slidably received therein such that a longitudinal axis of the pressurized gas container is substantially parallel to the longitudinal axis of the cavity, the dimension of the housing at the upper rim transverse of the longitudinal axis being substantially less than that of the base.

2. A stabilizing caddy as set forth in claim 1 wherein the housing is solid and substantially conical in shape; and wherein the cavity is tubular.

3. A stabilizing caddy as set forth in claim 1 wherein the housing is solid and substantially conical in shape; and wherein the cavity is substantially cylindrical in shape.

4. A stabilizing caddy as set forth in claim 1 wherein the base includes a planar plate;

wherein the housing includes a thin wall tubular member upstanding from the base; and wherein the space within the housing is substantially a void.

5. A stabilizing caddy as set forth in claim 4 including a plurality of circumferentially spaced rib members lying in planes substantially parallel to the longitudinal axis of the cavity integral with and extending between the tubular member and the planar plate.

6. A stabilizing caddy as set forth in claim 4 wherein the cavity is substantially cylindrical in shape.

7. A stabilizing caddy as set forth in claim 4 wherein the housing includes a floor integral and coplanar with the base obstructing the cavity and providing a support for the pressurized gas container when received in the cavity.

8. A stabilizing caddy as set forth in claim 1 wherein the space between the continuous side wall and the housing is substantially a solid.

9. A stabilizing caddy as set forth in claim 1 wherein the housing includes a floor integral and coplanar with the base obstructing the cavity and providing a support for the pressurized gas container when received in the cavity.

10. A stabilizing caddy for a pressurized gas container having a longitudinal axis comprising:

a planar base plate; and a substantially conical housing of thin wall construction upstanding from the planar base plate and having a space within the housing which is substantially a void defined by a continuous conical wall having an upper rim distant from the planar base plate and a longitudinal axis extending transverse of the planar base plate, the planar base plate having a central opening of substantially similar size to that of the upper rim such that, together, the central opening and the upper rim are supportively receptive of an outer surface of the pressurized gas container when the pressurized gas container is slidably received therein such that a longitudinal axis of the pressurized gas container is substantially parallel to the longitudinal axis of the cavity, the dimension of the housing at the upper rim transverse of the longitudinal axis being substantially less than that of the base.

* * * * *